US005899355A

United States Patent [19]

Claydon et al.

[11] Patent Number: 5,899,355

[45] **Date of Patent: * May 4, 1999**

[54] CAN BODY HAVING SIDEWALL GROOVES

[75] Inventors: Paul Charles Claydon; Christopher Paul Ramsey, both of Oxfordshire, United Kingdom

[73] Assignee: Carnaudmetal box ( Holdings) USA, Inc., Wilmington, Del.

[ * ] Notice: This patent is subject to a terminal disclaimer.

[21] Appl. No.: 08/944,043

[22] Filed: Sep. 12, 1997

Related U.S. Application Data

[63] Continuation of application No. 08/646,328, Jun. 4, 1996, Pat. No. 5,699,932.

[30] Foreign Application Priority Data

Dec. 4, 1993 [GB] United Kingdom ..... 9324910

[51] Int. Cl.[6] ..... B65D 6/38

[52] U.S. Cl. ..... 220/671; 220/674; 220/906

[58] Field of Search ..... 220/906, 671, 220/674, 62.12, 666, 667, 669, 670, 672, 673, 675, 703, 720, 907

[56] References Cited

U.S. PATENT DOCUMENTS

| | | | |
|---|---|---|---|
| D. 290,688 | 7/1987 | Moloney et al. . | |
| 4,953,738 | 9/1990 | Stirbis . | |
| 5,040,698 | 8/1991 | Ramsey et al. . | |
| 5,279,442 | 1/1994 | Jentzsch et al. . | |
| 5,699,932 | 12/1997 | Claydon et al. | 220/906 |

FOREIGN PATENT DOCUMENTS

| | | |
|---|---|---|
| 1022336 | 9/1984 | United Kingdom . |
| WO/9111275 | 1/1990 | WIPO . |

*Primary Examiner*—Stephen Castellano
*Attorney, Agent, or Firm*—Diller, Ramik & Wight, PC

[57] ABSTRACT

A metal container has a bottom wall and a side wall provided with a low relief pattern of shallow grooves or creases to define outwardly convex panels. The grooves or creases have a depth between 0.3 and 3% of the radius of the side wall which has thickness between 3 and 30% of the radius of the grooves.

7 Claims, 6 Drawing Sheets

CAN BODY HAVING SIDEWALL GROOVES

This application is a continuation of application Ser. No. 08/646,328, filed Jun. 4, 1996, now U.S. Pat. No. 5,699,932.

BACKGROUND OF THE INVENTION

This invention relates to can bodies comprising a side wall provided with grooves; and furthermore to a method and apparatus for making the can bodies.

Ribs and panels have been formed in the side wall of cans for several purposes such as:

a). To give an interesting appearance to the can body which may promote a brand image. Such can bodies are shown in British Design Registration 1022336 and U.S. Design Pat. No. 290,688. In both cases the can body depicted is a drawn seamless can body having flange, neck and shoulder from which depends an array of longitudinal ribs and panels: the panels appear to be broad and thus substantially chordal in relation to the round body;

b). Longitudinal ribs and panels have been used to give rigidity to the side wall against loads applied to the top of the can body, such as arise during double seaming of a can end to close the body, or during stacking of filled cans. This aspect is discussed in WO 91/11275 where it is said that the panels between the ribs extend chordally to strengthen the side wall and so permit use of thinner side walls. However when a can, having flat or shallow externally concave panels in a thin side wall, is filled and closed with a beverage that generates pressure, the panels are pushed outwardly to make the original rib and panel shapes less visible. Whilst this problem may be overcome by forming deeper chordal panels, as shown in U.S. Design Pat. No. 332,750 there is a limit to the ductility of a side wall made of double reduced tinplate or wall ironed steel.

c). To provide flexible panels which move to accommodate volume changes arising therefrom during filling and thermal processing of the contents of the closed can, and settle for the final shape arising. Such cans are described in U.S. Pat. No. 5,040,698 and are particularly suitable for containing thermally processed foods. The same principle may be applied to a can for pressurised beverages if the width of the longitudinal panel is narrow e.g over 30 panels for a can body 65 mm diameter; however there persists the problem that the shallow concave panels may be forced back to a continuous cylinder if pressure within the can is high and ribbed cans with concave panels are susceptible to damage to their coatings during manufacture and abrasion during transport.

U.S. Pat. No. 4,953,738 (Stirbis) describes a one piece metallic can body comprising an end wall and a cylindrical relatively thin side wall provided with a first annular groove at a short distance from the open end of the side wall and a second annular groove at a short distance from the bottom wall. A number of longitudinal externally concave grooves extend between the annular grooves to define a like number of panels in between the longitudinal grooves. In FIG. 2 Stirbis shows that the panels are of externally arcuate cross section approximating to the original cylindrical side wall before grooving so that the grooves are formed of stretch-formed material. The side wall of a can body made by drawing and wall ironing tinplate or aluminium is work hardened and has as little as 5% elongation to fracture. In order to avoid risk of fracture this invention seeks to provide a form of grooves and panels, and means to make them, that do not subject the side wall to excessive stretching.

EP-A-0547636 describes a drawn and wall ironed can body which has alternating inward and outward segments around its circumference. The apparatus used to achieve this configuration uses a hard mandrel with inward and outward segments which carries the can body. The can body is forced to conform with these segments by compressing the can against a plate covered with a resilient layer.

SUMMARY OF THE INVENTION

According to a first aspect of the present invention, there is provided a can body having a generally cylindrical side wall with at least one narrow externally concave groove characterised in that the or each groove has a depth of 0.3 to 3% of the radius of the can body; and the side wall has a thickness of 3 to 30% of the radius of the groove or grooves.

We believe that chordal panels which are externally concave or flat are not ideal for cans containing pressure because they return towards a generally cylindrical shape under pressure. However, we have surprisingly discovered that when the can body includes narrow shallow concave grooves in accordance with the present invention instead of chordal panels, such grooves do not revert to their original cylindrical shape.

Preferably, the grooves define externally convex panels between them. Such panels and grooves may be longitudinal, with panels being wider than the grooves and the grooves and panels extending between cylindrical portions of the side wall. The grooves and panels may usually connect directly with the cylindrical portions.

Typically, the grooves may comprise locally folded portions. Such folding gives a tight radius within the groove which holds the groove in place even if the can is internally pressurised. These grooves may emphasise features of decoration or may be used to provide abstract features and may also strengthen the can body, for example by having grooves extending in a longitudinal manner as described above. It should be realised that in fact the strongest container shape is a smooth plain cylinder. However, it is inevitable that blemishes and impact damage arise during storage, transport etc, which give rise to sites at which the can is weakened and may collapse during load. The provision of longitudinal shallow grooves has been found to compensate for such blemishes.

This invention provides in one embodiment a can body comprising a side wall provided with longitudinal externally concave grooves and convex panels which extend between cylindrical portions of the side wall, characterised in that, the grooves are between 0.5 mm and 1 mm wide between inflection points; the panels are wider than the grooves and have a radius of curvature less than that of the cylindrical portions; and the grooves and panels connect directly with the cylindrical portions of the side wall.

In this embodiment the can body may be formed by drawing and wall ironing to comprise a bottom wall and a side wall upstanding from the periphery of the bottom wall, the side wall comprising adjacent the bottom wall a first cylindrical portion of substantially equal thickness to that of the bottom wall; a second cylindrical portion of thickness less than that of the bottom wall; and an intermediate wall portion thinner than the second cylindrical portion and joined to the cylindrical portions by annular zones of tapering thickness wherein the externally concave grooves and externally convex panels terminate in the annular tapering zones.

In a preferred embodiment the perimeter of the grooves and panels, as measured at any position along the grooves and panels, is equal to the average perimeter of the cylindrical portions.

The grooves may have an arcuate cross section or have a parallel sided channel shape with a flat bottom.

According to a second aspect of the present invention, there is provided a method of forming externally concave grooves in the side wall of a can body by the steps of placing the cylindrical can body in a mandrel and rolling the can and mandrel along an arcuate rail of hard material provided with at least one protrusion and applying a pinch pressure between the mandrel and rail, in which the mandrel comprises either a complementary profile to the rail or at least an outer sleeve surface of elastomeric material, whereby application of the pinch pressure progressively imposes at least one externally concave groove in the side wall of the can body.

In one embodiment, this method comprises a method of forming externally concave grooves and externally convex panels in the side wall of a can body by the steps of placing the cylindrical can body on the mandrel having an elastomeric sleeve surface, and rolling the can and mandrel along an arcuate rail provided with a toothed profile, and applying a pinch pressure between the mandrel and rail progressively to impose a plurality of grooves extending longitudinally up the side wall of the can body to define the convex panels there between.

Preferably, the pinch pressure is such that the groove or grooves formed in the can body have a depth of 0.3 to 3% of the radius of the can body, the side wall having a thickness of 3 to 30% of the radius of the grooves.

According to a further aspect of the present invention, there is provided an apparatus for forming at least one groove in the side wall of the can, said apparatus comprising a frame, a turret driven to rotate about an axle fixed to the frame, a plurality of mandrels mounted around the turret for rotation on axles fixed to the turret, and a rail of hard material fixed to the frame having at least one protrusion and extending adjacent the turret, each mandrel having either a complementary profile to the rail or at least an outer sleeve surface of elastomeric material, so that as the turret rotates, each mandrel pinches the side wall of the can body against the rail progressively to form the groove or grooves.

Preferably, the or each protrusion is shaped such that the groove or grooves formed in the can body have a depth of 0.3 to 3% of the radius of the can body, the side wall having a thickness of 3 to 30% of the radius of the grooves.

In an embodiment of the invention which is advantageous for producing strengthening features in a can body this invention provides apparatus for forming a plurality externally concave grooves and externally convex panels in the side wall of a can, said apparatus comprising a frame, a turret driven to rotate about an axle fixed to the frame, a plurality of mandrels mounted around the turret for rotation on axles fixed to the turret, and a rail fixed to the frame having a profiled arcuate surface extending adjacent the turret so that, as the turret rotates, each mandrel pinches the side wall of the can body against the rail progressively to form the grooves and panels.

In preferred embodiments of the apparatus the rail is adjustable on the frame to permit adjustment of the pinch pressure of the rail profile on the can body.

The mandrel may usually have a surface layer of elastomeric material. Alternatively the mandrel may be made entirely of metal having a surface profile complementary to the profile of the rail.

Various embodiments will now be described by way of example and with reference to the accompanying drawings in which:

DESCRIPTION OF THE PREFERRED EMBODIMENT

Figure 1:
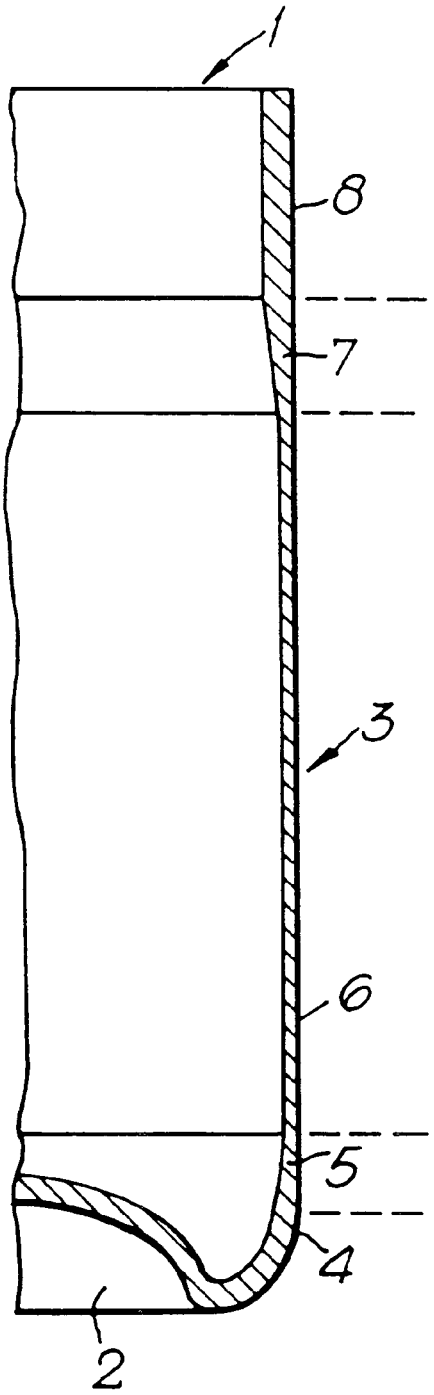
FIG. 1 is a fragmentary section of a known can body as made by drawing and wall ironing.

FIG. 1 shows a can body 1 comprising a bottom wall 2 and a substantially cylindrical side wall 3 upstanding from the periphery of the bottom wall. The can body is made by drawing sheet metal to a cup, which may or may not be redrawn to a reduced diameter, after which the drawn cup is pushed by a profiled punch through at least one wall ironing die to create a longer side wall thinner than the bottom wall.

Figure 4:
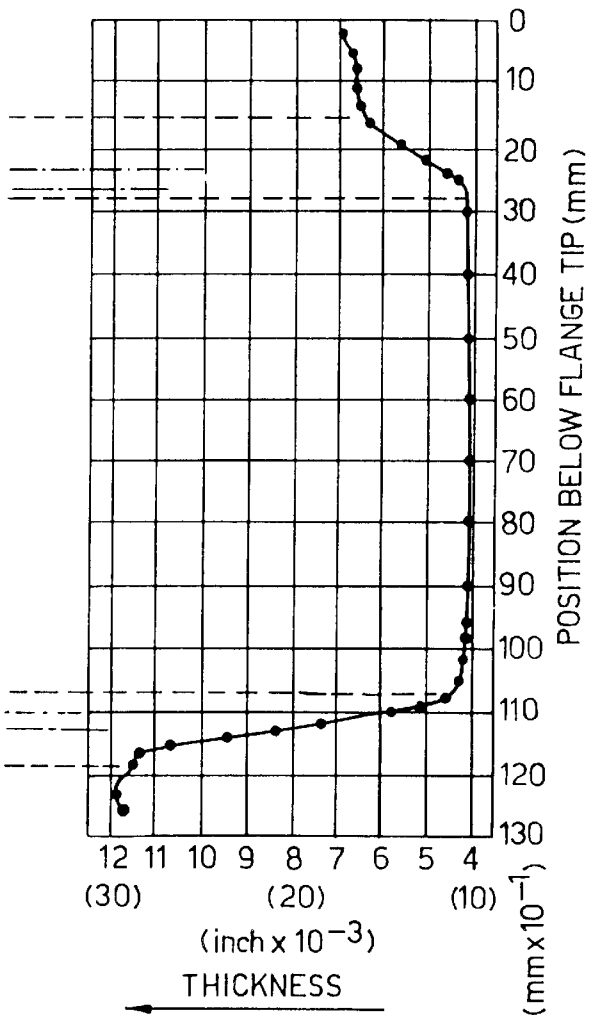
FIG. 4 is a graph of side wall thickness of the can body plotted against the position of measurement below the flange.

The can body shown in FIG. 1 is typically 66 mm diameter by about 120 mm tall. The bottom wall 2 is 0.012" (about 0.3 mm) thick and the wall ironed side wall 3 changes in thickness along its length as shown in FIG. 4. The side wall comprises a first cylindrical portion 4 adjacent the periphery of the bottom wall, a first annular zone 5 which reduces in thickness in a direction away from the bottom wall, a thin cylindrical wall portion 6 which constitutes the majority of the can height and extends away from the first annular zone to a second annular zone 7 which increases in thickness to join a second cylindrical wall portion 3 thicker than the cylindrical portion 6 but thinner than the bottom wall 2. The second cylindrical wall portion 8 defines the mouth of the wall ironed can body and is provided with the less thinned metal in order to avoid cracking of the work hardened metal around the mouth when a shoulder 9, neck 10 and flange 11 are formed on the body as shown in FIG. 3.

Figure 2:
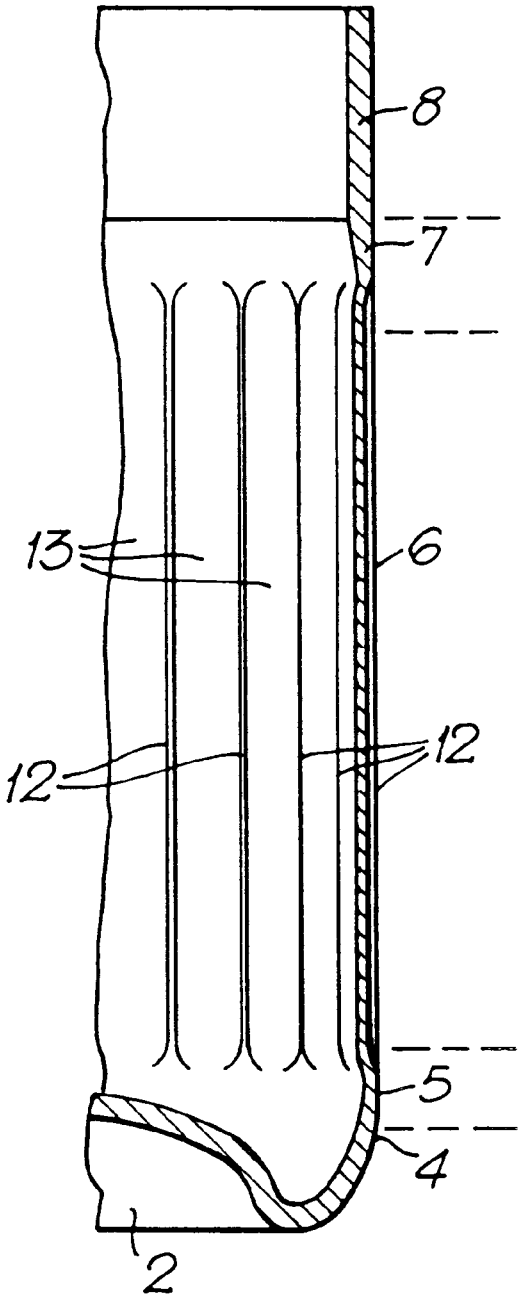
FIG. 2 is a fragmentary section of the can body of FIG. 1 after formation of the externally concave grooves and externally convex panels according to this invention.

FIG. 2 shows the can body of FIG. 1 after a plurality of externally concave grooves 12 have been imposed on the side wall to define a like number of externally convex panels 13. The grooves 12 and panels 13 extend parallel to the longitudinal axis of the can body 1 and terminate in the first and second annular zones (5, 7) of reducing thickness. This feature is important because it is possible to form the consistent terminal shapes of grooves and panels in these zones without significant stretching of the work hardened side wall metal. The shape of can body shown in FIG. 2 may be used to contain thermally processed foods but would need a can end closure having expansion panels.

Figure 3:
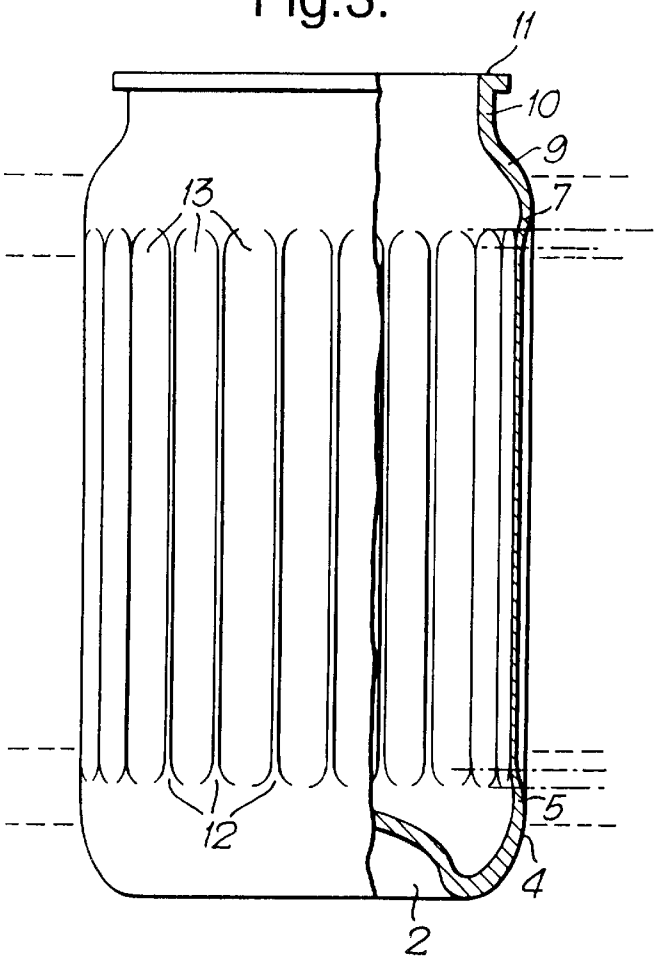
FIG. 3 is a cut-away view of the can body of FIG. 2 after provision of shoulder, neck and flange to complete a beverage can body.

FIG. 3 shows that the shoulder 9, neck 10 and flange 11 are typical of a beverage can formed after formation of the grooves and panels. Whilst it is possible to form the grooves 12 and panels 13 in a can body already provided with a shoulder neck and flange it is more convenient to perform the groove rolling process on a cylindrical body because the mouth is bigger to facilitate entry and removal of an internal mandrel, as will be described with reference to FIGS. 9 and 10, and because the grooves and panels confer column strength to the side wall about to be die necked.

Returning to FIG. 4 it will be seen that the first annular reducing zone reduces in thickness from 0.012" (0.30 mm) to 0.004" (0.10 mm). The grooves and lower end of the panels terminate in this zone, as shown by "dot-dash" lines. The second annular zone increases in thickness from 0.004 (0.1 mm) to about 0.006" (0.15 mm) and the upper end of the grooves and panels terminate in this upper zone as shown by "dot-dashed" lines.

Figure 5:
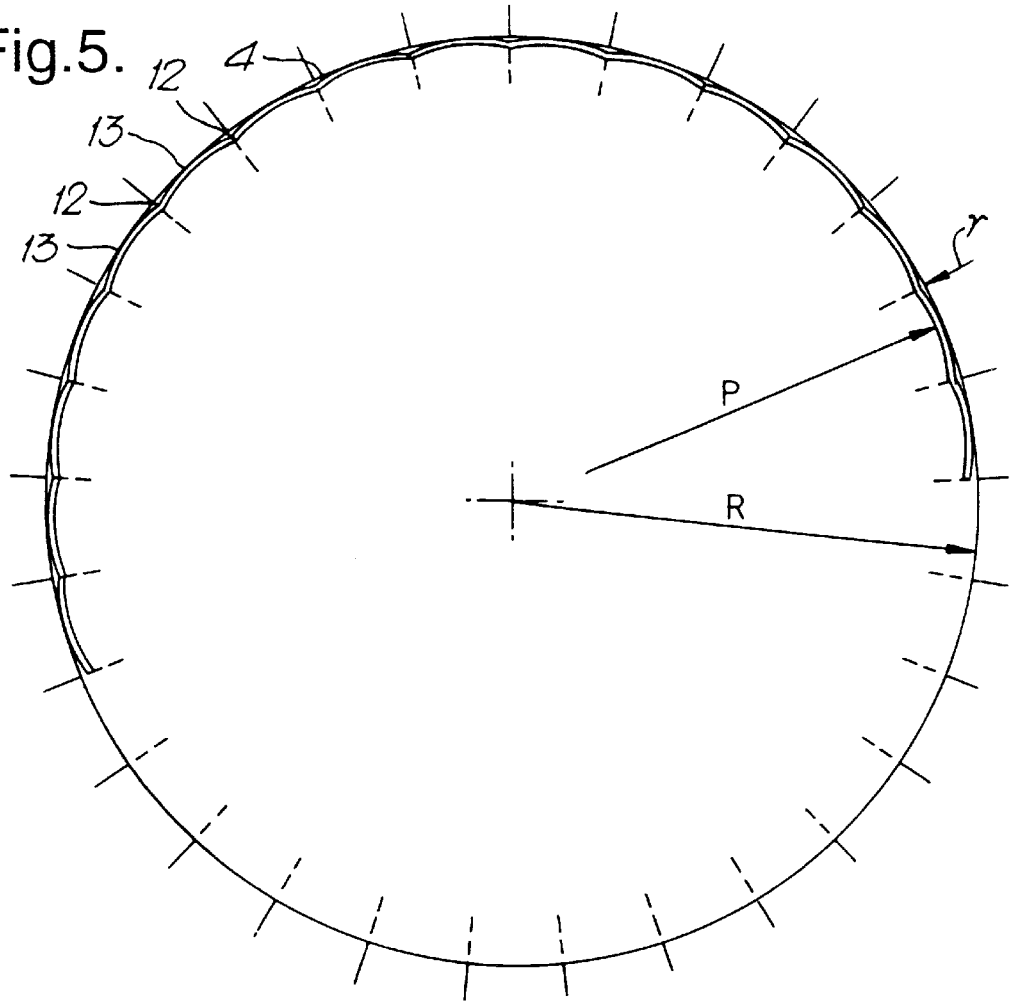
FIG. 5 is a diagram showing the groove and panel geometry on an enlarged scale.

FIG. 5 shows that the convex panels 13 are much wider than the externally concave grooves and in order to avoid excessive stretching of the side wall metal during formation of the grooves, the radius of curvature r of the ribs, the radius of curvature of the panels P and the radius of curvature of the cylindrical portions R are related by a general expression:

$$R=P+2r$$

Exact equality is not essential because the side wall of wall ironed cans will tolerate up to about 5% elongation before fracture but those skilled in the art will understand that the bending of the grooves and panels will put the outside surfaces of the bends in some tension and that it is preferable to design the panels and grooves to minimise the stress to achieve the strain reflected in the grooves and panel shapes shown.

Figure 6:
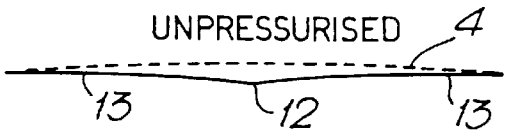
FIG. 6 is an enlarged fragment of sidewall in the as formed condition.

FIG. 6 shows a groove between two panels in the unpressurised state. The dashed line indicates one of the cylindrical portions 8 or 4. The same principles may be applied to can bodies in which the cylindrical portions 8 and 4 are of different diameter such as will arise in a frustoconical can body but such frustroconical bodies are made by deep drawing and are not wall ironed.

Figure 7:
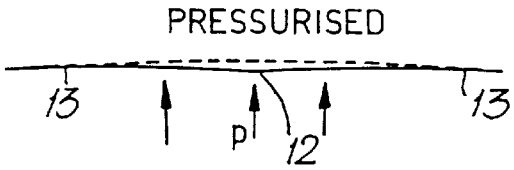
FIG. 7 is a like view to FIG. 6 showing the side wall fragment when pressurised by an internal pressure.

FIG. 7 shows grooves and panels in the pressurised state in which pressure "P" inside the can body has pushed the grooves outwards giving a small increase in container volume.

Figure 8:
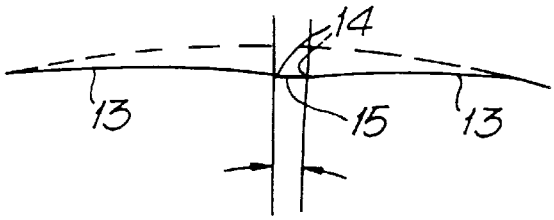
FIG. 8 is an enlarged fragment of an alternative shape of externally concave groove.

FIG. 8 shows an alternative form of groove which has parallel sides 14 and a relatively flat or chordal portion between the sides. The width of this flat or chordal portion 15 is narrow, preferably between 0.5 mm and 1.0 mm between inflection points to be consistent with the geometry already discussed with reference to FIG. 2 in respect of grooves of arcuate cross section and the minimising of stretch of the metal of the side wall.

We have found that it is desirable carefully to control the radial depth of the externally concave grooves in order to achieve maximum columnar strength.

Although a can having 29 grooves is described, it will be understood that beverage cans according to this invention may usefully have between 25 and 83 grooves/panels.

Figure 9:
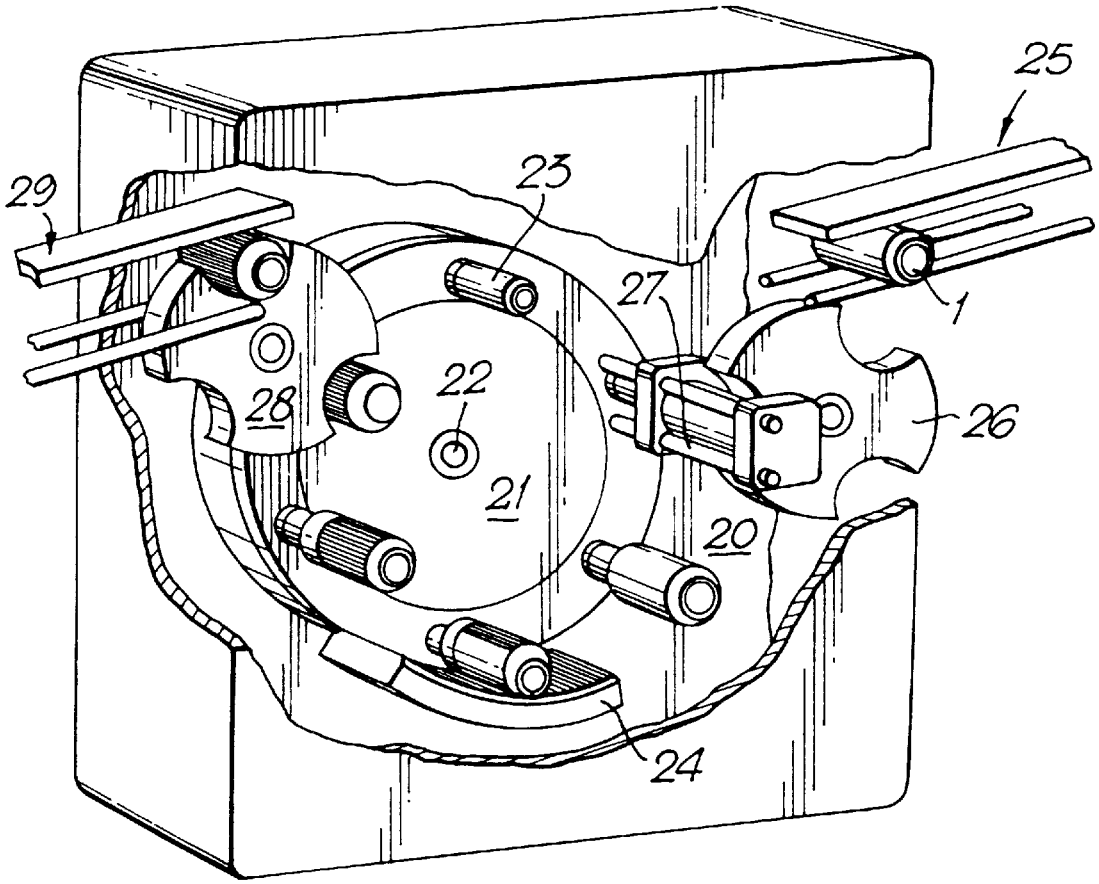
FIG. 9 is a perspective sketch of apparatus for forming the grooves and panels in the side wall of can body.

FIG. 9 shows apparatus for forming longitudinal grooves and panels in the side wall of a round can. The apparatus comprises a frame 20, a turret 21 driven to rotate about an axle 22 fixed to the frame 20, a plurality of mandrels 23 mounted around the turret for rotation on axles fixed to the turret, and a rail 24 having a profiled arcuate surface extending adjacent the turret so that as the turret rotates, each mandrel 23 rolls along the rail 24 profile as is shown on a larger scale in FIG. 10.

The apparatus further comprises means to feed a can body 1 onto each mandrel. As shown, a can body 1 rolls along an entry conveyor 25 from which it is taken by a star wheel 26 which rotates to bring the body into a transfer cage 27 which supports the can body in axial alignment with a mandrel. Each mandrel has a transfer cage but for simplicity only one cage 27 is shown in FIG. 9. As the turret continues rotation, the cage moves the can body axially to surround the mandrel.

After formation of the grooves and panels the transfer cage 27 retracts and a second star wheel 28 removes the ribbed can to an exit conveyer 29.

Figure 10:
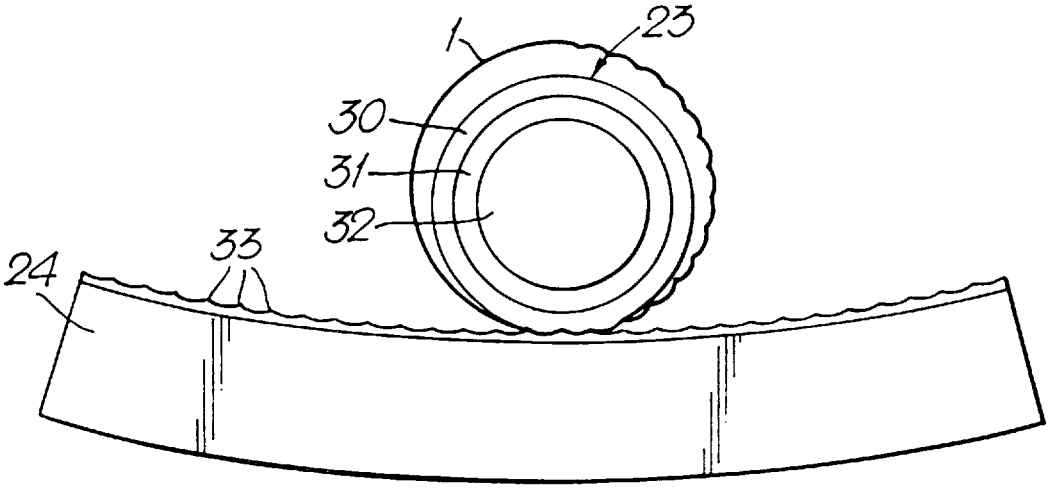
FIG. 10 is diagrammatic sketch of a can body, mandrel, and rail during roll forming of the grooves and panels.

FIG. 10 shows a can body 1 pinched between a mandrel 23 and rail 24 at a position about halfway along the rail profile so that about half the groove and panel profile has been formed. The mandrel has an external sleeve 30 of elastomeric material such as polyurethane, a tubular metal core 31, and the axle 32, fixed to the turret on which the core rotates. In preferred embodiments of the apparatus the axle 32 is driven to rotate to bring the can body to a speed which matches the linear rate of travel along the rail profile. Thereafter the mandrel is driven to rotate only by engagement of the can body with the rail.

The rail 24 is provided with adjustable support (not shown) which permits adjustment of the distance the teeth 33 of the profile of the rail will penetrate the elastomeric material to define the depth of grooves formed in the side wall of the can 1.

Adjustment of this penetration ensures that the forming of the grooves and panels is done by a rolling motion without slip so that surface coatings or decoration on the can body will not be spoiled by abrasion.

Alternatively, the rail can include protrusions which penetrate the side wall of the can body so as to emphasise and enhance surface decoration as will be described in more detail below.

Although FIG. 10 shows use of a mandrel having an elastomeric sleeve, this sleeve may be replaced if commercial demand for cans justifies the cost, by a metal mandrel having a profile complimentary with the profile of the arcuate rail.

Figure 11:
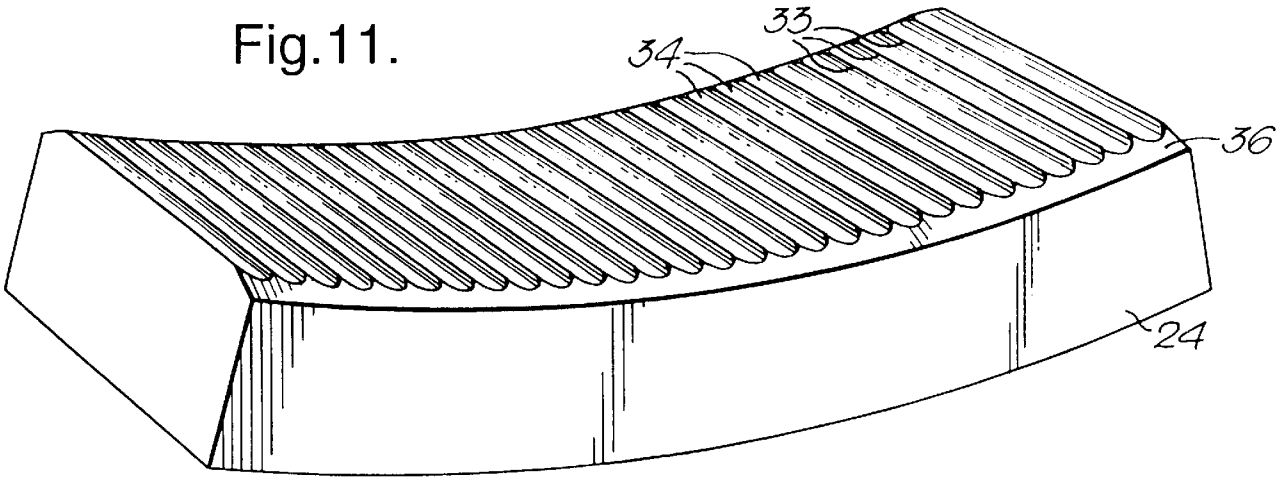
FIG. 11 is a perspective sketch of the rail shown in FIG. 10.
Figure 12:
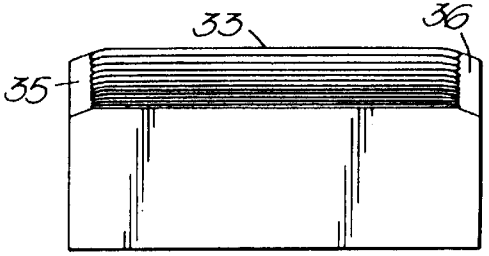
FIG. 12 is an end view of the rail of FIG. 11.
Figure 13:
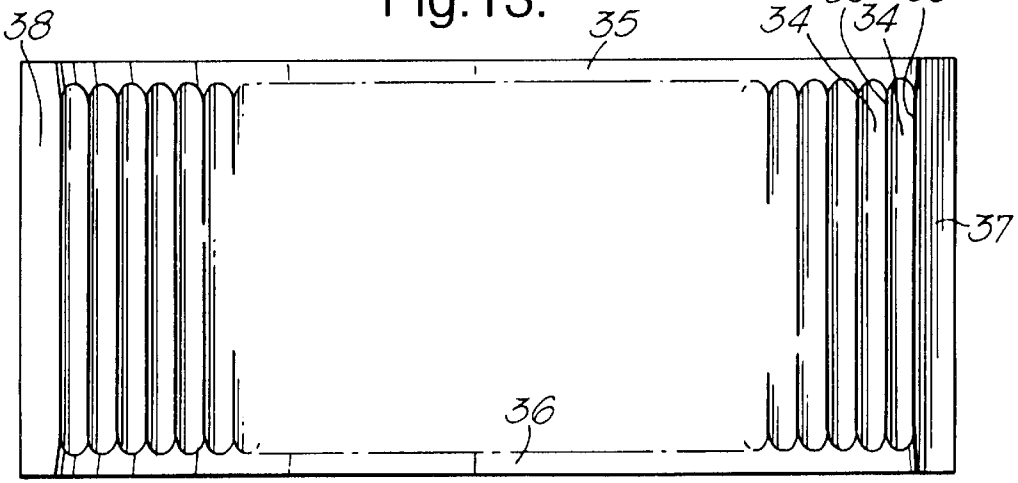
FIG. 13 is a plan view of the rail of FIG. 11.

FIG. 11, 12 and 13 show details of the arcuate rail. Referring to FIGS. 11 and 12 it will be seen that the rail 24 is thick so that the profile of teeth 33 and grooves 34 is rigidly supported against the working pinch force as arising as the mandrel travels along the rail. The teeth extend most of the distance across the rail but are flanked by inclined margins 35, 36 at each edge of the rail. The slope of these inclined margins extends to define inclined ends on each tooth so that the side wall metal is not pinched by localised end portions of the teeth which could impose localised stress, excessive strain and even piercing of the metal. As already stated the periphery of the grooves and panels is to be substantially equal to the periphery of the cylindrical side wall portions, even at the extremities of the grooves and panels. Shallow grooves may not fully define the top arches of the panels as shown in FIGS. 2 and 3, because the centre of the panel metal remains axially aligned with the cylindrical surfaces.

The rail as shown in FIG. 13 is preferably provided with a gently inclined surface 37 which the can body engages to synchronise the surface speed of rotation of the can with the linear rate of travel along the rail. The rail also may have an inclined exit surface 38 which the grooved can body passes over to leave the rail without abrasion or risk of a tooth imposing a double strike on the can side wall.

Figure 14:
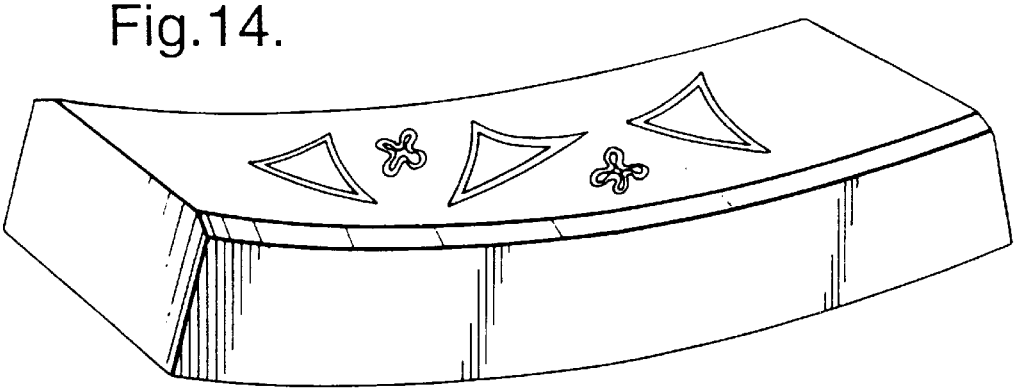
FIG. 14 is a perspective sketch of a rail with decorative features.
Figure 15:
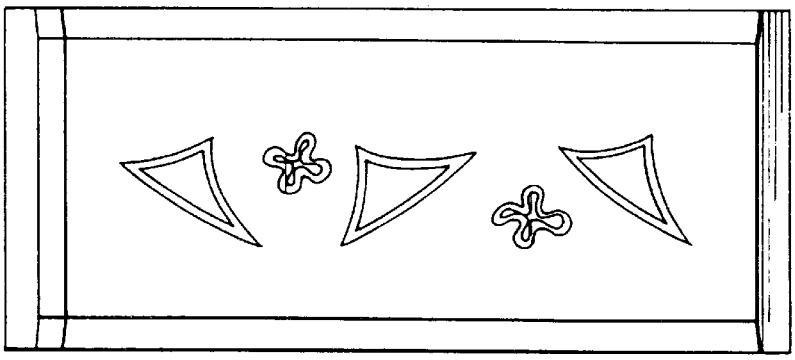
FIG. 15 is a plan view of the rail of FIG. 14.

FIGS. 14 and 15 show details of an arcuate rail for a second embodiment of the invention, in which protrusions on the rail are used to provide emphasised features of decoration in the can side wall by forming shallow grooves corresponding to the protruding rail profile. In general, such grooves are obtained by the use of a solid steel rail which penetrates into the elastomeric material of a flexible mandrel carrying the can body.

It is preferred that the mandrel be of elastomeric material rather than of hard material having a complementary surface to that of the rail since there is then no need to alter all the mandrels when a different surface decoration is required. The only requirement would be to change the arcuate rail to one having the desired protrusions for the new design.

Figure 16:
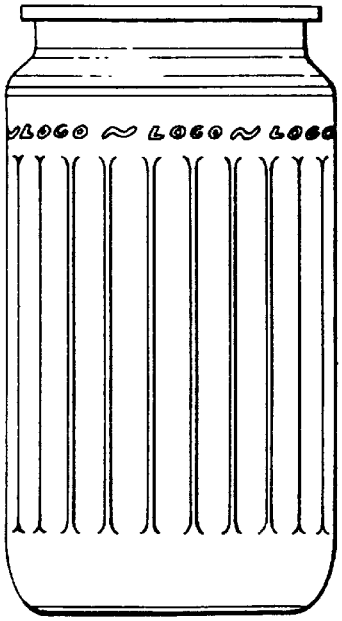
FIG. 16 is a can body having both strengthening and decorative ribs.
Figure 17:
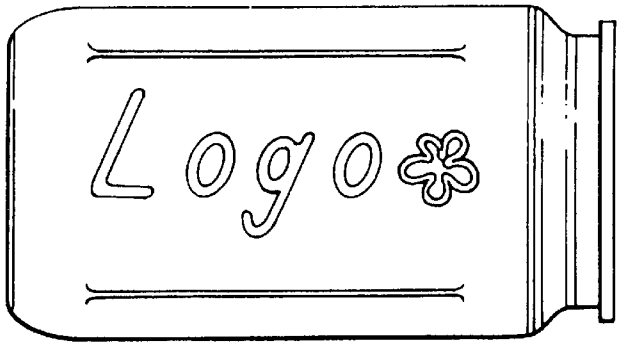
FIG. 17 is another can body with primarily decorative grooves.

FIGS. 16 and 17 show two embodiments of can body which include features of both decoration and strengthening, formed by the use of a solid profiled rail.

In these low relief designs, the grooves may be set to shape by the pinch pressure between the mandrel and rail, so that the panels between the grooves are pulled elastically to shape.

In FIG. 16, the longitudinal grooves and panels have been formed as described with reference to FIGS. 1 to 13 above but a logo has also been added in the portion above the grooves and panels. This logo is formed simply by additional protrusions on the profiled rail.

The can body of FIG. 17 includes less strengthening grooves than that of FIG. 16 but has a larger printed logo, the cutline of which is defined by outwardly concave creases in the can side wall. Such large features may be particularly attractive to the customer to emphasise brand image and may also be used to assist recognition by the blind or partially sighted consumer. The features are not only visually attractive and have a functional and tactile appeal to them.

The use of concave grooves as a decorative feature is particularly useful since cans often abut each other when on the manufacturing line, in transport, storage or display. The external profile of the can body with concave grooves remains the same so that the risk of scuffing of the feature during transport is minimised.

The radius of the grooves formed in the can bodies must preferably be chosen within the range of 0.3 to 3% of the can body and the thickness of the can side wall may typically be between 3 and 30% of the radius of the creases. There is substantially no change in the thickness of the can body as the grooves are formed by "folding". If the radius is too tight, then the material of the side wall will split, but if it becomes too large then the grooves will not hold their profile should the can be pressurised as will arise for example when a can contains a carbonated beverage.

Typical values for the formation of grooves for decorative purposes in a can having a radius of 32.5 mm are given in the table below, where R is the radius of the can body, d is the depth of the groove, r is the radius of the groove and t is the thickness of the can side wall:

| | R | d | r | t | % d/R | r/t | % t/r |
|---|---|---|---|---|---|---|---|
| typical | 32.5 | 0.5 | 1.5 | 0.1 | 1.5 | 15 | 6.7 |
| maximum | 32.5 | 1.0 | 2.5 | 0.08 | 3.0 | 35 | 3.2 |
| minimum | 32.5 | 0.1 | 0.5 | 0.15 | 0.3 | 3 | 30 |

It will be appreciated that the invention has been described above by way of example only and that changes may be made without departing from the scope of the invention as defined by the claims. For example, the can body may be of a variety of materials, including aluminium and steel and the can may be of either two or three piece configuration, although grooves or creases are naturally more readily formed in a softer aluminium body and are particularly suited for two piece beverage cans where a carbonated beverage generates pressure in the closed can. Indeed, it is considered to be within the scope of the present invention to provide a can body according to the claims, in which carbonated beverage or other product within the can has been used to provide resistance to the tool used for folding the can body to form the grooves.

We claim:

1. A can body (1) comprising a generally cylindrical side wall having a plurality of narrow externally concave grooves (12), each groove having a depth of 0.3% to 3% of the radius of the can body, said side wall having a thickness of 3% to 30% of the radius of the grooves and each groove has a radius of 1.54% to 7.7% of the can body radius.

2. A can body according to claim 1 in which the grooves (12) extend longitudinally between cylindrical portions (4, 8) of the side wall.

3. A can body according to claim 2 in which the grooves (12) define longitudinally externally convex panels (13) therebetween which extend between the cylindrical portions (4, 8), the panels being wider than the grooves and having a radius of curvature less than that of the cylindrical portions, and in which the grooves (12) and panels (13) connect directly with the cylindrical portions (4, 8) of the side wall.

4. A can body according to claim 3 which is formed by drawing and wall ironing to comprise a bottom wall (2) and a side wall (3) upstanding from the periphery of the bottom wall, the side wall (3) comprising adjacent the bottom wall (2) a first cylindrical portion (4) of substantially equal thickness to the bottom wall, a second cylindrical portion (8) of thickness less than that of the bottom wall distant from the bottom wall, and an intermediate wall portion (6) and joined to the cylindrical portion by zones of tapering thickness (5, 7) wherein the externally concave grooves (12) and externally convex panels (13) terminate in the tapering zones (5, 7).

5. A can body according to claim 3 wherein the perimeter of the grooves (12) and panels (13) as measured at any position along the grooves and panels is equal to the average of the perimeters of the cylindrical portions.

6. A can body according to claim 3 wherein the externally concave grooves (12) have an arcuate cross section.

7. A can body according to claim 3 wherein the grooves (12) and panels (13) alternate and are equispaced around the can body.

* * * * *